United States Patent [19]

Gonterman

[11] Patent Number: 4,649,943

[45] Date of Patent: Mar. 17, 1987

[54] CIGARETTE FILTER AND METHOD OF MAKING THE SAME

[75] Inventor: Ricky A. Gonterman, Louisville, Ky.

[73] Assignee: Brown & Williamson Tobacco Corporation, Louisville, Ky.

[21] Appl. No.: 700,565

[22] Filed: Feb. 11, 1985

[51] Int. Cl.[4] ..... A24D 3/04

[52] U.S. Cl. ..... 131/336; 493/39; 493/281

[58] Field of Search ..... 131/281, 336, 339, 340; 493/39

[56] References Cited

U.S. PATENT DOCUMENTS

| | | | |
|---|---|---|---|
| 4,362,171 | 12/1982 | Johson et al. | 131/336 |
| 4,406,294 | 9/1983 | Lamb | 131/336 |
| 4,406,295 | 9/1983 | Sanford et al. | 131/336 |
| 4,469,111 | 9/1984 | Pinck et al. | 131/336 |

*Primary Examiner*—V. Millin

*Attorney, Agent, or Firm*—Charles G. Lamb

[57] ABSTRACT

A filter for a cigarette includes a porous filter rod circumscribed by an air impermeable wrapper and ventilation grooves embedded in the wrapped filter rod which extend from one end of the filter rod a preselected distance generally longitudinally thereof. A plurality of ventilation air flow apertures are formed through the wrapper. Some of the air flow apertures are located in the grooves and others of the air flow apertures are formed in the area of the wrapper outside of the grooves. An air impermeable tipping material circumscribes the wrapped filter rod. The tipping material is formed with a plurality of ventilation air flow apertures therethrough such that each ventilation air flow aperture through the tipping material is in substantial registration with a different one of the ventilation air flow apertures formed through the wrapper. In addition, a method for making the above described filter includes the steps of forming a generally cylindrical filter rod of porous material; with a circumscribing air impervious wrapper material, embedding at least one groove in the wrapped filter rod extending from and open to one end of the filter a preselected distance generally longitudinally of the filter rod less than the length of the filter rod; circumscribing the grooved filter rod with an impermeable tipping material; concurrently forming perforations through the tipping paper and underlaying wrapper material in a region outside the at least one groove; and concurrently forming at least one perforation in the tipping material over the at least one groove.

11 Claims, 4 Drawing Figures

CIGARETTE FILTER AND METHOD OF MAKING THE SAME

BACKGROUND OF THE INVENTION

1. Field of the Invention

This invention relates to a filter for cigarettes. In one aspect it relates to a filter with novel ventilating means. In another respect the invention relates to a filter for a cigarette having flow directing grooves formed therein for directing ventilating air to the mouth end of the filter and concurrently delivering diluted smoke through the filter to the mouth end of the filter.

2. Description of the Prior Art

It is well known in the art to add filters to cigarettes wherein the filters are provided with ventilation means to bring ambient air into the filter to dilute the smoke stream passing therethrough. The dilution of the smoke stream reduces the quantity of smoke particulates as well as the gas phase components which are delivered to the smoker's mouth. A number of means have been proposed and are utilized for introducing ventilating air into the cigarette. For example, the wrapper for the tobacco in a cigarette can be made from a porous material which allows for introduction of air along the entire length of the cigarette where it mixes with the smoke stream passing therethrough thereby diluting the smoke in the stream. Also the cigarette wrapper may be perforated at selected locations along the length of the cigarette which provides ports in the cigarette through which ventilating air enters. Even further, it is known to perforate the wrapper of the filter on the cigarette to allow ventilating air to enter the filter and dilute the smoke stream. There have also been a number of suggestions for incorporating grooves within the filter of a filter cigarette to facilitate the addition of ventilating air into the smoke stream.

For example, U.S. Pat. No. 3,596,663 relates to a tobacco smoke filter provided with a corrugated porous plug wrap surrounding a filter element which is circumscribed by tipping paper having flow-through perforations. The ventilating air enters into the filter element and the grooves through the perforations in the tipping paper and progresses to the smoker's mouth. And, U.S. Pat. No. 4,256,122 teaches a filter for a cigarette which includes grooves extending longitudinally along the outer surface of a filter rod circumscribed by a non-porous plug wrap and the rod and wrap are enclosed with ventilating tipping paper so that in use only ventilating air travels down the grooves and only smoke travels through the filter. Also, U.S. Pat. No. 4,406,293 teaches a filter with grooves in the outer surface for ventilating air and also means to introduce ventilating air into the body of the filter. Other patents which relate to cigarette filters having grooves circumscribing the filter element for the introduction of ventilating air into the cigarette filter include U.S. Pat. No. 3,577,995; U.S. Pat. No. 3,752,347; U.S. Pat. No. 3,490,461; U.S. Pat. No. 3,788,330; U.S. Pat. No. 3,773,053; U.S. Pat. No. 3,752,165; U.S. Pat. No. 3,638,661; U.S. Pat. No. 3,608,561; U.S. Pat. No. 4,256,122 and U.S. Pat. No. 3,910,288.

SUMMARY OF THE INVENTION

The present invention advantageously provides a straightforward arrangement of a filter for a cigarette which provides a cigarette filter for lowering tar predominantly by ventilation while also providing filtration of the tobacco smoke. The present invention further provides a filter ventilation system for a cigarette utilizing grooves in the filter plug extending from the ventilating air perforations in the tipping paper to one end, preferably the mouth end of the filter.

More particularly, the present invention provides a filter for a cigarette comprising a porous filter rod of generally cylindrical configuration, an air impermeable wrapper extending longitudinally along said filter rod from one end thereof to the other and circumscribing said filter rod leaving flow through opposing ends of said rod, said wrapper being formed with at least one groove embedded into said filter rod, said at least one groove being open at one end of said filter rod and extending therefrom in a generally longitudinal direction of said filter rod for a distance less than the length of said filter, at least one perforation formed through said wrapper in the embedded portion thereof defining the at least one groove, a plurality of perforations formed through said wrapper in a region outside of said at least one groove, air impermeable tipping material extending longitudinally of and circumscribing said wrapped filter rod, and a plurality of perforations formed through the tipping material, at least one of the perforations being in air flow communication with the at least one groove, and the other perforations in the tipping paper being in air flow communication with the perforations through the wrapper in the region of the wrapper outside of the at least one groove. a The present invention further provides a method for making a filter for a cigarette comprising forming a generally cylindrical filter rod of porous material with a circumscribing air impermeable wrapper, embedding at least one groove into the wrapper and filter rod with one end of the groove open to one end of the filter rod and extending therefrom generally longitudinally of the filter rod for a distance less than the length of the filter rod, circumscribing the filter rod with an tipping material, forming perforations through the tipping material and through the wrapper in a region outside of the at least one groove, and concurrently forming at least one perforation in the at least one groove and at least one perforation in the tipping material over the at least one groove.

BRIEF DESCRIPTION OF THE DRAWINGS

These and other features of the present invention will become even more clear upon reference to the following description and in conjunction with the accompanying drawing wherein like numbers refer to like parts throughout the views and in which.

DESCRIPTION OF THE PREFERRED EMBODIMENT

Figure 1:
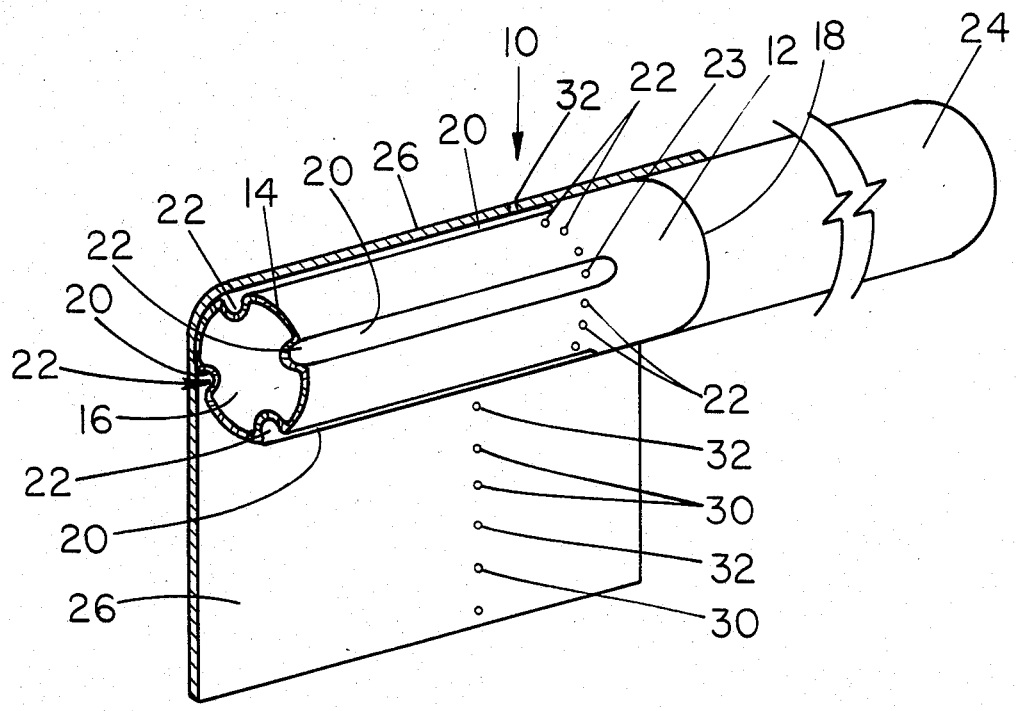
FIG. 1 is a perspective view of a cigarette incorporating the filter of the present invention with the tipping material partially unwrapped.
Figure 2:
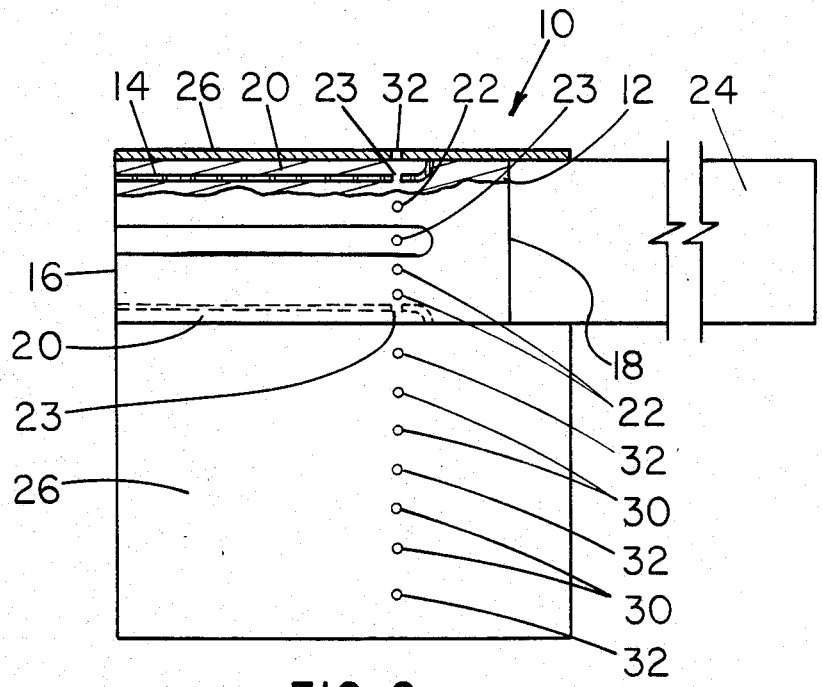
FIG. 2 is a longitudinal side view, partially in action, of the filter construction of FIG. 1.

FIGS. 1 and 2 illustrate a cigarette filter, generally denoted as the numeral 10, incorporating the features of the present invention. The cigarette filter 10 is shown as comprising a generally cylindrically shaped filter rod 12 and a circumscribing air impervious wrapper 14. The air impervious wrapper 14 extends longitudinally along the filter rod 12 from one end 16 of the filter rod to the other end 18 thereof so that the filter rod ends 16 and 18 are in mutual flow through relationship.

The filter rod 12 is fabricated of a porous material such as, for example, fibrous or foamed cellulose acetate, or any other material suitable for filtering cigarette smoke.

The cigarette filter 10 further comprises a plurality of grooves 20 formed in the wrapper 14 and embedded into the filter rod 12. Each of the grooves 20 is open at one of its ends 22 to the mouth end 16 of the filter rod 12, and extends therefrom in a generally longitudinal direction of the filter rod 12 for a distance less than the length of the filter rod. FIGS. 1 and 2 illustrate four grooves 20 equally spaced from each other about the circumference of the filter rod 12.

In the manufacture of the filter 10, the wrapper 14 can be integrally formed with the filter rod, or can be a separate component. The wrapped filter rod is placed in a mold, or other treating means, for depressing the wrapper 14 at selected locations thus embedding the wrapper into the filter rod and forming the grooves 20. One such method is commonly referred to in the cigarette manufacturing field as heat molding technique.

The embedded portions of the wrapper 14 defining the walls of the groove 20 are impermeable to air as are the other or peripheral areas of the wrapper 14 outside the grooves 20. To this end, the wrapper 14 of the present invention can be fabricated of a porous, air permeable material such as, for example, a fibrous or foamed cellulose acetate and treated to make the wrapper 14 impermeable. One such treatment is to, for example, apply heat to the wrapper material to heat seal the porous material. Another effective treatment is to coat the wrapper 14 with a chemical such as a water insoluble solution or material, for example ethylcellulose, or a water-soluble material such as, for example, sodium carboxymethylcellulose or methylcellulose which seals the pores. Preferably, the wrapper 14 can be fabricated of an air impermeable material such as, for example, a closed cell cellulose acetate.

The wrapper 14 is perforated with a plurality of small perforations 22 through the wrapper 14 in an area or region outside of the grooves 20, and with at least one perforation 23 formed through the wrapper 14 in each of the embedded portions thereof defining the grooves 20. As shown, the perforations 22 and perforations 23 are located in a common circumferential array about the circumference of the wrapper 14 and filter rod 12. In addition, each of the perforations 23 is located proximate the closed end of its respective groove 20, that is, the groove end opposite the groove end which is open to the filter rod mouth end 16.

The wrapped filter rod 12 is attached to a tobacco column 24 with a tipping material 26 which circumscribes the wrapper covered filter rod 12 to form a filtered cigarette. The impermeable tipping material 26 is rendered air permeable in selected locations so that ventilating air will flow through it and into the grooves 20, and also into the filter rod 12 through the air impermeable wrapper 14 outside of the grooves 20 through the perforations 22. In addition, a portion of the ventilation air in the grooves 20 also flows into the filter rod 12 through the perforations 23. Thus, ventilation air flows into the filter rod 12 substantially about the circumference of the filter rod 12 thereby evenly diluting smoke flowing through the filter rod 12 from one end to the other. To this end, the tipping material 26 is illustrated as being formed with flow-through ventilating air perforations 30 and 32 in a common circumferential array. As illustrated, the perforations 30 are in air flow communication with the perforations 22 formed in the wrapper 14 outside of the grooves 20 and the perforations 32 overlay the grooves 20 proximate the closed end of the grooves 20. As shown, the perforations 30 are formed through the tipping material 26 are in substantial axial alignment with and overlaying the perforations 22 through the wrapper 14 outside of the grooves 20 to provide for the air flow communication therethrough into the filter rod 12. The perforations 32 are illustrated as each being formed through the tipping material 26 in substantial axial alignment with a different one of the perforations 23 through the wrapper 14 in a different one of the grooves 20 proximate the closed end of the groove 20 to provide for the flow of ventilation air into the grooves 20.

Figure 3:
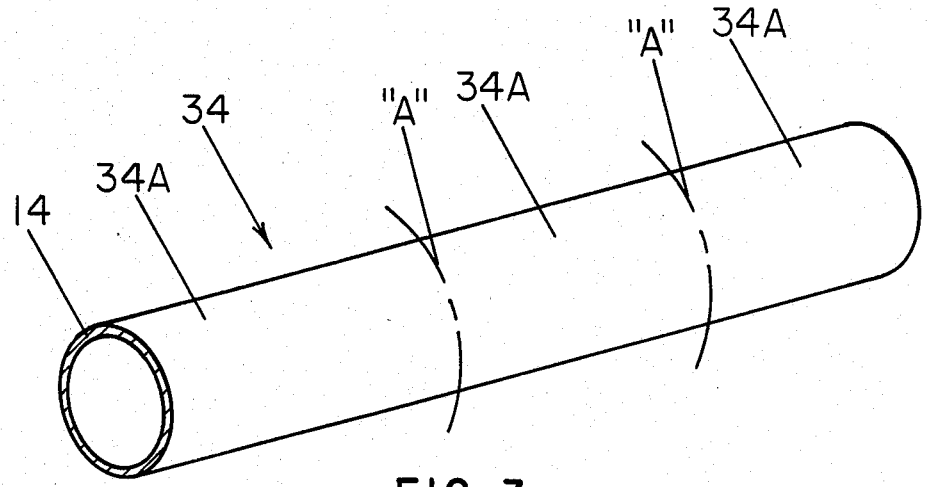
FIG. 3 is a perspective view of a filter rod from which the filter of the present invention is made; and, FIG. 4 is a perspective view of a filter rod segment from which the filter of the present invention is made.
Figure 4:
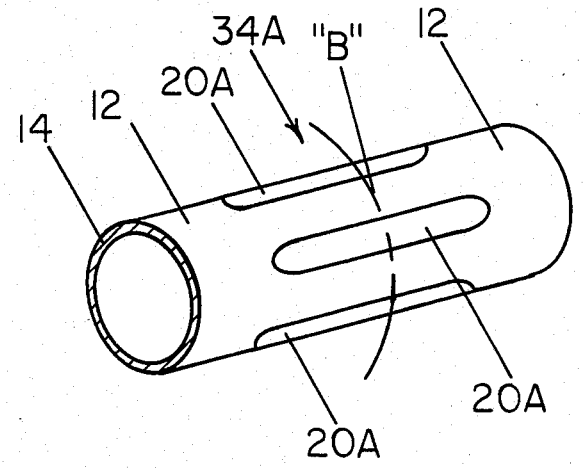

With reference to FIG. 3, the first step in the manufacturing process of making the filter 10 is to form an elongated generally cylindrical filter tow 34 of a porous material such as, for example, fibrous or foamed cellulose acetate. The length of the tow 34 is a multiple of the length of a filter rod 12. Advantageously,, the wrapper 14 is wrapped about the circumference of the filter tow 34 concurrently with the forming of the filter tow 34. This can be accomplished in various known ways. One heretofore known method is to pass a web of porous material, which will form the tow 34, contemporaneously with another, overlaying web of non-porous material, which will form the wrapper 14, through a garniture funnel of a filter making machine. After the wrapped tow 34 is formed, it is cut transversely to its longitudinal axis, as indicated by the broken lines "A" in FIG. 3, into tow segments 34A of predetermined length of, for example, twice the length of a filter rod 12. Next, with reference to FIG. 4, the tow segments 34A are formed with embedded longitudinal grooves 20A corresponding to twice the length of the grooves 20 in the filter rod 12. Preferably, the double length grooves are symmetrically located relative to the longitudinal center line of the tow segment 34A. The double length grooves 20A can be formed in the tow segments 34A by various known apparatus and methods, for example, by heated blades which are forced against the periphery of the tow segment 34A to depress the wrapper material into the tow material. Each tow segment 34A is then cut transversely of the longitudinal axis at the longitudinal centerline "B" producing two filter rods 12.

Each filter rod 12 is located in longitudinal alignment with the tobacco column 24 with its end 18 in substantial abutment with one end of the tobacco column 24. The filter rod 12 is then attached to the tobacco column by circumscribing the filter rod 12 and a portion of the tobacco column 24 adjacent the filter rod end 18 with the impervious tipping material 26 in a manner known to the art of cigarette making to form a filtered cigarette.

After the filter cigarette is assembled, the perforations 30 and 32 are formed through the tipping material 26 and the perforations 22 and 23 are formed through the wrapper material 14 concurrently and in one operation. This is accomplished by the use of a high energy beam, such as a laser beam aimed or directed against filter 10 in a predetermined location to concurrently and rapidly burn a perforation 30 through the tipping material 26 and an aligned or registered perforation 22 through the wrapper material 14 in a region outside of the grooves 20, and a perforation 32 through the tipping material 26 and an aligned perforation 23 through the wrapper material 14 in the grooves 20.

When a smoker draws on the mouth end 16 of the filter 10 while smoking the cigarette 28, ventilating air is simultaneously drawn through the perforations 32 of the tipping material 26 into the grooves 20, and through the perforations 30 of the tipping material 26 and perforations 22 of the wrapper material 14 directly into the filter rod 12 in the regions of the filter rod 12 between adjacent grooves 20. A portion of the ventilating air entering the grooves 20 travels directly to the open end 22 of the groove at the mouth end of the filter rod without mixing with smoke flowing through the filter rod because of the impervious walls of the grooves, and another portion of the air in the grooves 20 passes through the perforations 23 of the wrapper material 14 into the filter rod 12. The ventilating air entering the filter rod through the perforations 22 and 23 of the wrapper material 14 mixes with and uniformly dilutes the smoke in an annular volume in the filter rod 12. The ventilating air flowing out of the grooves 20 at the filter mouth end 16 causes a turbulence in the flow stream of the diluted smoke leaving the filter rod at the filter mouth end 16, further diluting the already diluted smoke in the mouth of the person drawing on the filtered cigarette.

The foregoing details of the present invention are given primarily for clearness of understanding and no unnecessary limitations should be understood therefrom for modifications will become obvious to one skilled in the art upon reading this disclosure and can be made without departing from the spirit of the invention and scope of the appended claims.

What is claimed is:

1. A filter for a cigarette comprising:

a porous filter rod of generally cylindrical configuration;

an air impermeable wrapper extending longitudinally along said filter rod from one end thereof to the other end and circumscribing said rod leaving flow-through opposed ends of said filter rod;

said wrapper being formed with at least one groove embedded into said filter rod, said at least one groove being open at one end of said filter rod and extending therefrom in a generally longitudinal direction of said filter rod for a distance less than the length of said filter rod;

at least one perforation formed through said wrapper in the embedded portions thereof defining the at least one groove;

a plurality of perforations formed through said wrapper in a region outside of said at least one groove;

air impermeable tipping material extending longitudinally of and circumscribing said wrapped filter rod; and, a plurality of perforations formed through the tipping material, at least one of the perforations being in flow communication with the at least one groove, and each of the other perforations being in air flow communication with a different one of the perforations through the wrapper in the region of the wrapper outside the at least one groove.

2. The filter of claim 1, wherein the perforations through the tipping material and the perforations through the wrapper outside of the grooves which are in flow communication are in substantial registration with each other.

3. The filter of claim 1, wherein the perforation formed through the wrapper in the at least one groove is located proximate the closed end of the at least one groove.

4. The filter of claim 3, wherein the at least one perforation through the tipping material in flow through communication with the at least one groove is in substantial alignment with the at least one perforation formed through the wrapper in the at least one groove.

5. The filter of claim 1, wherein the perforations formed through the tipping material are in a spaced apart circumferential array about the circumference of the filter.

6. A method of making a filter for a cigarette comprising the steps of:

forming a generally cylindrical filter rod of porous material with a circumscribing air impervious wrapper;

embedding at least one groove into the wrapper and filter rod with one end thereof open to one end of the filter rod and extending therefrom generally longitudinally of the filter rod for a distance less than the length of the filter rod;

circumscribing the filter with tipping material;

concurrently forming perforations through the tipping material and through the wrapper in a region outside of the at least one groove; and, concurrently forming at least one perforation in the at least one groove and at least one perforation in the tipping material over the at last one groove.

7. The method of claim 6, wherein the step of forming perforations through the tipping material and wrapper in a region outside the groove comprises forming the perforations in a spaced apart circumferential array about the circumference of the filter.

8. The method of claim 7, wherein the steps of forming perforations through the tipping material and wrapper in the region outside the groove and forming at least one perforation in the tipping material over the at least one groove comprises forming all of the perforations through the tipping material in a common circumferential array and forming all of the perforations through the wrapper in a common circumferential array.

9. The method of claim 8, wherein the step of forming perforations through the tipping material and wrapper in the region outside the groove comprises forming these perforations in substantial mutual registration.

10. The method of claim 9, wherein the step of forming at least one perforation in the at least one groove and at least one perforation in the tipping material over the at least one groove comprises forming these perforations in substantial mutual alignment.

11. The method of claim 10, wherein the steps of forming perforations through the tipping material and through the wrapper comprise cutting the perforations with a laser.

* * * * *